United States Patent [19]

Cross

[11] Patent Number: 4,861,275

[45] Date of Patent: Aug. 29, 1989

[54] VERY HIGH DENSITY INTERCONNECTIONS

[75] Inventor: William D. Cross, Vista, Calif.

[73] Assignee: Hughes Aircraft Company, Los Angeles, Calif.

[21] Appl. No.: 220,056

[22] Filed: Jul. 15, 1988

[51] Int. Cl.[4] ..... H01R 13/04

[52] U.S. Cl. ..... 439/289; 439/492

[58] Field of Search ..... 439/77, 289, 492–499

[56] References Cited

U.S. PATENT DOCUMENTS

| | | | |
|---|---|---|---|
| 3,079,458 | 2/1963 | Hedstrom | 439/77 |
| 3,478,297 | 11/1969 | Gimpel et al. | 439/289 |
| 3,731,258 | 5/1973 | Spicer | 439/289 |
| 3,950,058 | 4/1976 | Cronin . | |
| 4,066,312 | 1/1978 | Faure | 439/289 |
| 4,181,386 | 1/1980 | Olsson . | |
| 4,252,389 | 2/1981 | Olsson . | |
| 4,252,392 | 2/1981 | Whiteman, Jr. . | |
| 4,269,462 | 5/1981 | Bethurum . | |
| 4,367,006 | 1/1983 | Rehbogen, Jr. et al. . | |
| 4,367,513 | 1/1983 | Cronin . | |
| 4,416,497 | 11/1983 | Brandsness et al. . | |
| 4,470,100 | 9/1984 | Rebaudo et al. . | |
| 4,477,137 | 10/1984 | Ayer . | |
| 4,493,146 | 1/1985 | Cronin . | |
| 4,630,874 | 12/1986 | Renn . | |
| 4,634,195 | 1/1987 | Shoemaker . | |

OTHER PUBLICATIONS

Hughes Drawings #1 and #2.

*Primary Examiner*—Joseph H. McGlynn
*Attorney, Agent, or Firm*—Joseph E. Szabo

[57] ABSTRACT

A cable and connector section comprising a section of cable (13), including an elongated, flexible body (19) of insulating material and a plurality of conductors (21) carried by the body. Each of the conductors (21) terminates in a conductor end (25). A connector body section (15) on the section of flexible cable (13) is usable for connecting the section of flexible cable to another member (15a, 37). A plurality of contacts (17) are provided on the conductor end (25), respectively, to achieve a high-contact density.

11 Claims, 2 Drawing Sheets

VERY HIGH DENSITY INTERCONNECTIONS

BACKGROUND OF THE INVENTION

1. Field of the Invention

This invention relates to a connector for use with flexible cable and to a method of making such a connector.

2. Description of Related Art

A flexible cable typically includes an elongated, flexible body of insulating material and a plurality of conductors in the body. It is often necessary to connect a flexible cable of this type to various other circuit components, such as a motherboard or another flexible cable.

In many prior art connectors, the contact density is lower than desired for some applications. For example, in these prior art connectors, the contacts may be on 50 mil centers.

The gold dot system disclosed in Reardon et al U.S. Pat. No. 4,125,310 provides a very good zero insertion force connector. However, heretofore the gold dot system has not been used to provide very high density contacts for an end-to-end connection between a flexible cable and another member.

SUMMARY OF THE INVENTION

This invention substantially increases contact density at the end of a flexible cable by dramatically reducing the required center-to-center spacing of the contacts. With this invention, the center-to-center spacing of the contacts may be less than 10 mils. In addition, this invention reduces the discontinuities found is some prior art connectors and this is of particular significance for impedance controlled cables. Overall connector size is also minimized.

This invention utilizes a conventional section of flexible cable which includes an elongated flexible body of insulating material and a plurality of conductors carried by the body. Each of the conductors terminates in a conductor end. A connector body section is mounted on the section of flexible cable, and the connector body section is for use in connecting the section of flexible cable to another member.

A plurality of contacts are provided on the conductor ends, respectively. Thus, this invention utilizes the conductors of the flexible cable in the fabrication of the contacts. This enables the contacts to have a center-to-center spacing which is the same as the center-to-center spacing of the closely packed conductors of the cable. It also enables a straight line interconnection with another connector body section.

In a preferred construction, the connector body has a face and the conductor ends and the contacts are both adjacent the face. Optimally, the conductor ends are substantially flush with the face and the contacts protrude from the face for engagement with mating contacts of another member. The connector body, which is preferably constructed of molded plastic material may optionally carry R.F. shielding.

The connector body section can be coupled to another connector body section of the same or similar design. Alternatively, it can be coupled to virtually any member having a set of contacts arranged in a pattern to be compatible with the contacts carried by the connector body section. A set of contacts is compatible with another set of contacts if any contact of the first set is arranged to engage any contact of the second set.

According to the method of this invention, a section of flexible cable and a connector body section are provided as discussed above and contacts are attached onto the conductor ends, respectively. It is preferred to mold the connector body section onto the section of flexible cable. Material is then preferably removed from the face of the connector body to expose the conductor ends. Next, the conductors are attached, preferably by plating, onto the conductor ends.

Another feature of the method of this invention is the ease with which multiple sections of flexible cable and connector body sections can be made. This can be accomplished, for example, by molding or otherwise providing a connector body on an elongated flexible cable intermediate the ends of the flexible cable and then cutting the flexible cable and the connector body generally transverse to the direction to the elongation of the flexible cable. This provides two sections of flexible cable, each with its own connector body section.

The invention, together with additional features and advantages thereof may best be understood by reference to the following description taken in connection with the accompanying illustrative drawing.

DESCRIPTION OF THE PREFERRED EMBODIMENTS

Figure 1:
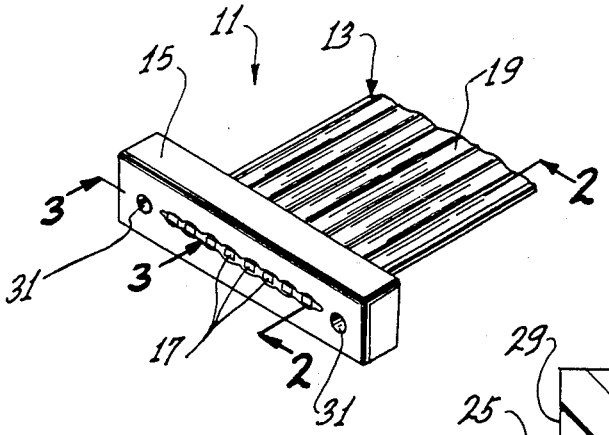
FIG. 1 is a fragmentary, isometric view of a connector section constructed in accordance with the teachings of this invention.
Figure 2:
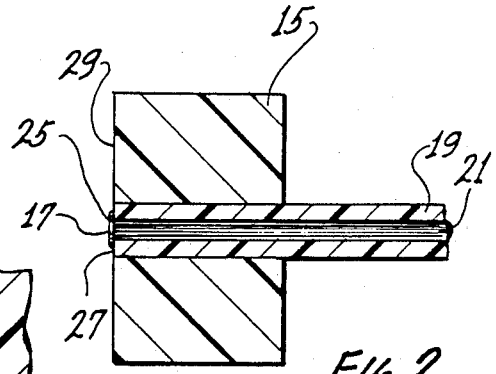
FIGS. 2 and 3 are fragmentary, sectional views taken generally along lines 2—2 and 3—3, respectively, of FIG. 1.
Figure 3:
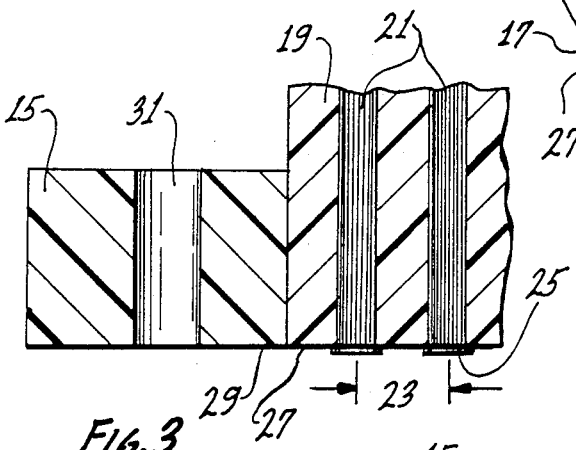

FIG. 1 shows a connector section 11 which comprises a section of flexible cable 13, a connector body section 15 and a plurality of contacts 17. The section of flexible cable 13 may be of conventional construction and comprises an elongated flexible body 19 (FIGS. 1–3) of a suitable electrically insulating material and a plurality of elongated flexible conductors 21 embedded in, and carried by, the body. In this embodiment, the body 19 is constructed of a suitable plastic material, and the conductors 21 are constructed of copper. The conductors 21 extend in the direction of the elongation of the body 19. The conductors 21 are spaced apart and have a known center-to-center spacing 23 as shown in FIG. 3, which may be, for example, 10 mils. Each of the conductors 21 terminates in a conductor end 25 (FIGS. 2 and 3) which is preferably flat, perpendicular to the longitudinal axis of the conductor and substantially in the same plane as, or flush with, an end surface 27 of the body 19.

The connector body section 15 is provided on an end portion of the section of flexible cable 13. Preferably, the connector body section 15 is molded onto the section of flexible cable and is constructed of a suitable rigid plastic material. Although the connector body section 15 can be of various different configurations, it has a face 29 which is preferably flush with the end surface 27 and the conductor ends 25 as shown in FIGS. 2 and 3. In the embodiment of FIGS. 1–3, each of the conductor ends 25, the end surface 27 and the face 29 is planar and all of these surfaces lie in the same plane.

The connector body section 15 may have means to facilitate coupling of the connector body section to another member. Although such means may take various different forms, in this embodiment, it includes passages 31 extending completely through the connector body section on opposites side of the section of flexible cable 13. The connector body section 15 can be relatively small in relation to the width of the section of flexible cable 13, and in this embodiment, the additional width of the connector body section 15 provides space for the passages 31.

The contacts 17 are attached directly onto the conductor ends 25, respectively, and this can be accomplished, for example, using conventional plating techniques. For example, each of the contacts 17 may be a gold dot of the type described in Reardon et al U.S. Pat. No. 4,125,310. Preferably each of the contacts 17 is of slightly greater area than the conductor end 25 to which it is attached, and therefore, the contacts 17 overlie regions of the end surface 27 contiguous the conductor ends 25. Each of the contacts 17 protrudes slightly from the end surface 27 and the face 29.

Figure 4:
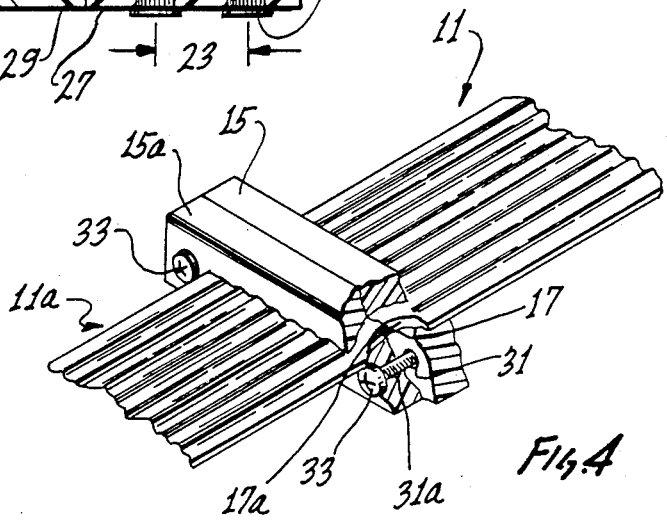
FIG. 4 is a fragmentary, isometric view illustrating one form of cable and connector of this invention.

The connector section 11 provides a first set of contacts 17, and it can be used with various different members, and in different ways, to provide engagement with at least some of the contacts of a second set of contacts. In this regard, FIG. 4 shows the connector section 11 coupled to an identical connector section **11*a*. Portions of the connector section 11*a* corresponding to portions of the connector section 11 are designated by corresponding reference numerals followed by the letter "a." As shown in FIG. 4, the connector body sections 15 and 15*a* are joined together by threaded fasteners 33 which extend through the aligned passages 31 and 31*a*. The fasteners 33 couple the connector sections 11 and 11*a* together with the contacts 17 and 17*a*** in engagement. In this manner, two sections of flexible cable can be readily interconnected.

Because the contacts 17 are attached directly to the conductors 21, the center-to-center spacing of the contacts is the same as the center-to-center spacing 23 of the end surfaces 27. Accordingly, the contact density can be the same as the conductor end 27 density in that the connector does not require an enlargement or fanning out of the contact.

Figure 5:
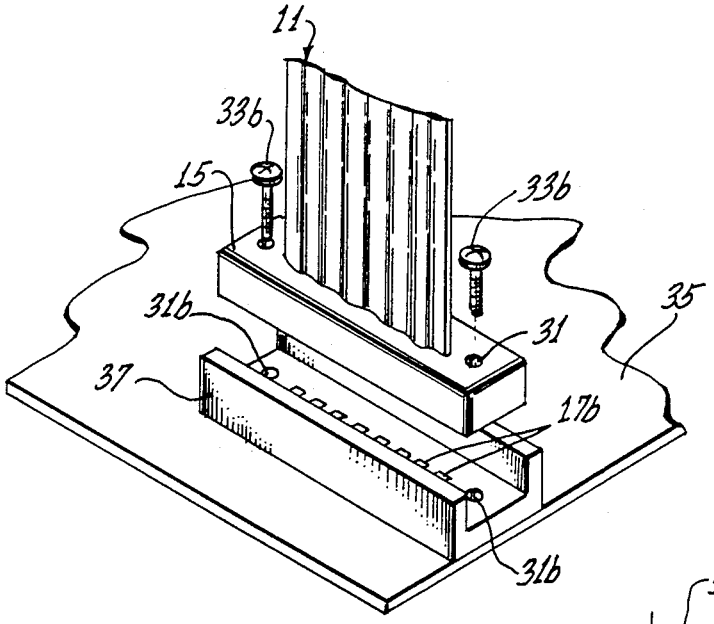
FIG. 5 is a fragmentary, isometric view showing how the connector section can be attached to a motherboard.

FIG. 5 shows the connector section 11 in the process of being coupled to a motherboard 35 by a suitable female connector 37 which, in this embodiment, is channel shaped. The female connector 37 provides a second set of contacts **17*b* arranged in the same pattern as the contacts 17. Accordingly, by coupling the connector body section 15 and the female connector 37 in any suitable manner, such as by threaded fasteners 33*b*, the contacts 17 are placed into engagement with the contacts 17*b*, respectively. The fasteners 33*b* pass through the passages 31 and 31*b* to couple the connector body section 15 and the female connector 37. The contacts 17*b* may be provided on the female connector 37 in any suitable manner. Of course, the connector body section 15 could be in the form of a female connector and could, by way of example, have the channel-shaped configuration of the female connector 37**.

Both of the connections provided in the FIGS. 4 and 5 provide a straight through form of connection, i.e. the contacts **17*a* (FIG. 4) and 17*b* (FIG. 5) are axially aligned with the associated conductors 21 of the connector section 11**. This provides an advantage for impedance controlled cables.

Figure 7:
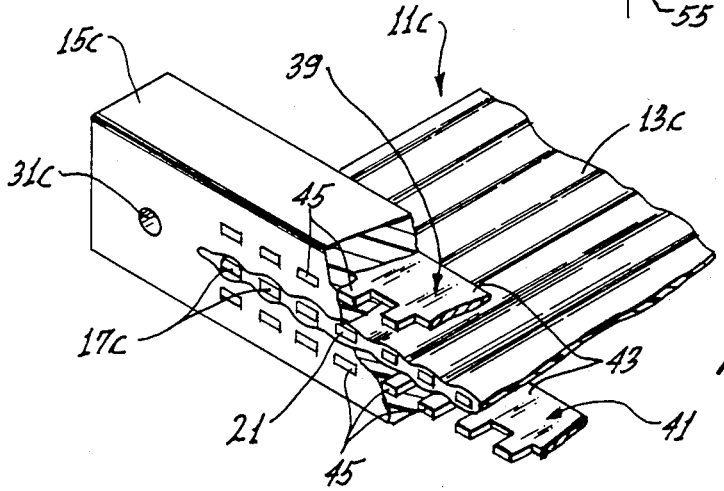
FIG. 7 is a fragmentary, isometric view partially in section of a connector section which includes R.F. shielding.

FIG. 7 shows one way in which R.F. shielding can be embodied in a connector section **11*c*. The connector section 11*c* is identical to the connector section 11 in all respects not shown or described herein, and portions of the connector section 11*c* corresponding to portions of the connector section 11** are designated by corresponding reference numerals followed by the letter "c."

The connector section **11*c* is identical to the connector section 11, except for the incorporation of R.F. shields 39 and 41 into the connector body section 15*c* and the necessary increase in size of the connector body section 15*c* to accommodate the shields. The shields 39 and 41 are embedded in the connector body sectoin 15*c* in spaced relationship to the section of flexible cable 13*c*. The shields 39 are constructed of a suitable conductive material, such as copper, and are positioned on the opposite sides of the conductors 21 such that the end portion of the section of flexible cable 13*c* is sandwiched between them. Although the shields 39 can be of various different configurations, in this embodiment, they are identical, and each of them includes a strip 43 extending transversley across the section of flexible cable 13*c* and tabs 45 projecting forwardly from the associated strip. The tabs 45 are integral with the associated strip 43 and are positioned directly above and below, respectively, the associated conductor 21. In addition, each of the tab 45 is of essentially the same size and configuration as the section of the conductor 21 with which it is associated. The shielded connector section 11*c*** can be used in any of the ways described above.

The connector section 11 can be made by a method which includes molding the connector body section 15 onto the section of flexible cable 13. Material is then removed from the face 29 to expose the conductor ends 25, and this can be accomplished, for example, by trimming, sanding and/or polishing of the face 29. The contacts 17 are then plated onto the conductor ends 25.

Figure 6:
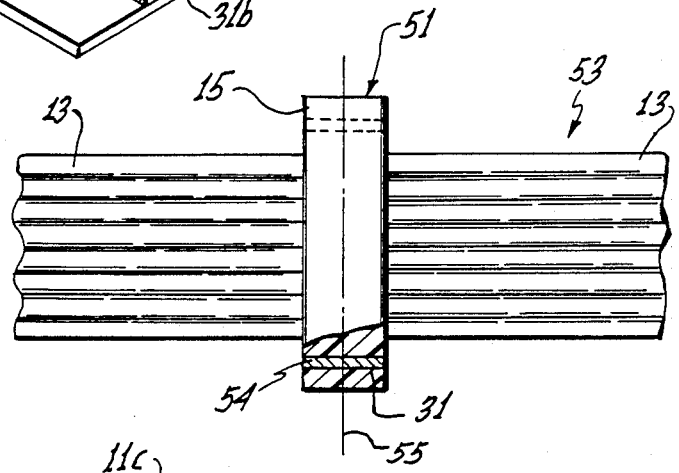
FIG. 6 is a fragmentary, plan view partially in section illustrating a method feature of this invention.

According to another method feature of this invention, a connector body 51 (FIG. 6) of plastic material is molded onto a flexible cable 53 intermediate the ends of the flexible cable, with pins 54 being used to form the passages 31. Next, the flexible cable 53 and the connector body 51 are cut along a transverse line 55 to provide two of the sections 11 of flexible cable and connector body sections 15. Following this, the method steps described above regarding trimming, sanding and polishing of the face 29 and the plating on of the contacts 17 can be carried out.

In the examples described above, only a single row of the conductor ends 25 and associated contacts 17 arranged linearly and transversely to the direction of elongation of the section of flexible cable 13 is employed. However, the invention is equally applicable to one or more rows of conductor ends 25 and associated contacts 17 arranged in various different ways.

Although exemplary embodiments of the invention have been shown and described, many changes, modifications, and substitutions may be made by those having ordinary skill in the art without necessarily departing from the spirit and scope of this invention.

What is claimed is:

1. A cable and connector section comprising:

a section of flexible cable including an elongated, flexible body of insulating material and a plurality of conductors carried by said body, each of said conductors terminating in a conductor end;

a connector body section on the section of flexible cable for use in connecting the section of flexible cable to a member, said connector body section having a face and said conductor ends being adjacent said face; and a plurality of contacts on said conductor ends, respectively, said contacts protruding from said face.

2. A cable and connector section as defined in claim 1 wherein said conductor ends are substantially flush with said face.

3. A cable and connector section as defined in claim 1 wherein said connector body constructed of molded plastic material.

4. A cable and connector section as defined in claim 1 including R.F. shielding carried by said connector section.

5. A cable and connector comprising:

a section of flexible cable including an elongated flexible body of insulating material and a plurality of conductors in said body, each of said conductors terminating in a conductor end;

a connector body section on the section of flexible cable, said connector body section having a face and said conductor ends being adjacent said face;

a first set of contacts, the contacts of said first set of contacts being on said conductor ends respectively, said contacts protruding from said face;

a member having a second set of contacts thereon in a pattern compatible with the first set of contacts; and means for coupling said connector body and said member with at least some of the first set of contacts engaging at least some of the second set of contacts.

6. A cable and connector as defined in claim 5 wherein said section of flexible cable is a first section of flexible cable, said connector body section is a first connector body section and saide member includes a second section of flexible cable and a second connector body section of the second section of flexible cable, with the second section of flexible cable including an elongated, flexible body of insulating material and a plurality of conductors in said body, with each of the conductors terminating in a conductor end, the contacts of said second set of contacts being on the conductor ends of the second section of flexible cable.

7. A method of comprising:

providing a section of flexible cable and a connector body section on the flexible cable with the section of flexible cable including an elongated flexible body of insulating material and a plurality of longitudinal, flexible conductors carried by the insulating body and with the conductors terminating in exposed conductor ends, respectively; and attaching contacts onto said conductor ends, respectively.

8. A method as defined in claim 7 wherein said step of attaching includes plating the conductors, respectively, onto conductor ends.

9. A method as defined in claim 7 wherein said step of providing includes providing a connector body on an elongated flexible cable intermediate the ends of the flexible cable and cutting the flexible cable and the connector body generally transverse to the direction of elongation of the flexible cable to thereby provide said section of flexible cable and said connector body section and a second flexible cable section and a second connector body section.

10. A method as defined in claim 7 wherein said step of providing includes molding the connector body section onto the section of flexible cable.

11. A method as defined in claim 10 wherein the connector body has a face, said step of providing includes removing material of the face of the connector body section to expose the conductor ends and said step of attaching includes plating the conductors, respectively, onto the conductor ends.

* * * * *